US010934055B2

(12) United States Patent
Ferro et al.

(10) Patent No.: US 10,934,055 B2
(45) Date of Patent: Mar. 2, 2021

(54) EXPANDABLE PACKAGING

(71) Applicants: Jay Ferro, Goleta, CA (US); John Stump, Santa Barbara, CA (US)

(72) Inventors: Jay Ferro, Goleta, CA (US); John Stump, Santa Barbara, CA (US)

( * ) Notice: Subject to any disclaimer, the term of this patent is extended or adjusted under 35 U.S.C. 154(b) by 0 days.

(21) Appl. No.: 15/945,585

(22) Filed: Apr. 4, 2018

(65) Prior Publication Data

US 2019/0308773 A1 Oct. 10, 2019

(51) Int. Cl.

| | |
|---|---|
| ***B65D 21/08*** | (2006.01) |
| ***B65D 1/42*** | (2006.01) |
| ***B65D 43/02*** | (2006.01) |
| *B65D 51/28* | (2006.01) |

(52) U.S. Cl.

CPC ..... *B65D 21/086* (2013.01); *B65D 1/42* (2013.01); *B65D 43/0208* (2013.01); *B65D 51/28* (2013.01); *B65D 2251/023* (2013.01)

(58) Field of Classification Search

CPC .... B65D 21/086; B65D 1/225; B65D 1/0292; B65F 2220/1066; A45F 2003/205; A47G 2019/22778; A47G 2019/2277

USPC ..... 215/900; 220/666

See application file for complete search history.

(56) References Cited

U.S. PATENT DOCUMENTS 4,095,728 A * 6/1978 Chlystun ..... B65D 47/063 222/529
4,572,412 A * 2/1986 Brach ..... B65D 1/0223 215/382
4,790,361 A * 12/1988 Jones ..... B65D 1/0292 215/12.1
5,439,128 A * 8/1995 Fishman ..... A45F 3/20 206/218
5,900,293 A * 5/1999 Zettle ..... B29C 49/04 220/666
6,105,815 A * 8/2000 Mazda ..... B65D 1/0292 215/382
9,044,082 B2 * 6/2015 Kusuma ..... A45F 3/20
(Continued)

FOREIGN PATENT DOCUMENTS

DE 3937456 A1 * 5/1991 ..... B65D 21/086
JP 09077072 A * 3/1997 ..... B65D 21/086
(Continued)

OTHER PUBLICATIONS

JP09150833_translation.pdf (Year: 1997).*

*Primary Examiner* — Allan D Stevens
(74) *Attorney, Agent, or Firm* — Patent Service Associates, Inc.; Lyman Smith

(57) ABSTRACT

An expandable bowl has an open top and a plurality of configuration changing side members connecting the open top to a base member. The configuration changing side members are designed to allow a user to pull the base member to changing the side members from a collapsed configuration to an expanded configuration, thereby increasing the overall volume of the bowl. The expandable bowl may be useful for various products, such as pre-packaged salads, where the salads may be packaged and displayed in the collapsed configuration, thereby minimizing shelf space, and may be changed to the expanded configuration by a user to permit tossing of the salad without risking spillage of the contents of the bowl.

16 Claims, 8 Drawing Sheets

(56) References Cited

U.S. PATENT DOCUMENTS

| | | | | |
|---|---|---|---|---|
| 2006/0219725 | A1* | 10/2006 | Ferro | B65D 21/086 220/666 |
| 2009/0114657 | A1* | 5/2009 | Hsu | A47G 19/02 220/574 |
| 2009/0270830 | A1* | 10/2009 | Sano | B65D 1/0261 604/403 |
| 2010/0183773 | A1* | 7/2010 | Malone | B65D 21/086 426/107 |
| 2011/0311688 | A1* | 12/2011 | Becraft | B65D 21/086 426/111 |
| 2013/0181000 | A1* | 7/2013 | Miksovsky | A45F 3/20 220/780 |
| 2016/0145035 | A1* | 5/2016 | Bates | B65D 85/187 206/292 |
| 2018/0194517 | A1* | 7/2018 | Brooks | B65D 21/068 |

FOREIGN PATENT DOCUMENTS

| | | | | |
|---|---|---|---|---|
| JP | 09150833 | A * | 6/1997 | B65D 21/086 |
| WO | WO-9323301 | A1 * | 11/1993 | A45F 3/20 |
| WO | WO-9405555 | A1 * | 3/1994 | B65D 1/165 |

* cited by examiner

EXPANDABLE PACKAGING

BACKGROUND OF THE INVENTION

1. Field of the Invention

One or more embodiments of the invention relates generally to containers. More particularly, the invention relates to an expandable container useful for containing food products, such as salads, pre-packaged for a consumer.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Salads from food service establishments, primarily quick-service restaurants, grocery stores, grab & go food stands such as at the airport, or the like, are typically sold in plastic containers that typically look like salad bowls with a lid. Often times, the salad and its toppings are packed to the top of the container in order to use all available container space, with the lid possibly stabilizing the entire salad contents.

However, there are problems with this existing arrangement. First, since it is difficult and time consuming to achieve a uniform dispersion of salad dressing on the entire salad within that same container, when a customer pours on the salad dressing, they have no choice but to put it on only the top of the salad, thereby getting too much on some parts and not enough on others. Second, often times, customers use more salad dressing than they need because of this problem. Third, when the customer does attempt to toss the salad, they must either empty the contents into a larger bowl and use utensils to toss, or attempt tossing it in the existing container, thereby losing product and creating a mess. Fourth, when the salad is not tossed, customers often eat the salad toppings because that is what is most accessible and leave the lettuce at the bottom of the bowl. This can significantly defeat the intended texture and experience of the salad, especially when the salads were intended to be tossed (for example, a Caesar salad and the like).

Customers often justify paying two to three times the amount of money for a similar tossed salad, primarily due to the ease of consuming and an intended experience of consuming the pre-tossed salad is greater. Many quick service restaurants often therefore price similar but un-tossed salads lower than the pre-tossed counterparts, because of the real or imagined compromise in their product and not giving the customer the anticipated perceived salad consuming experience and value. Further, when a salad is tossed, different people desire different amounts of salad dressing, dictated by many factors including taste, diet, and the like.

In view of the foregoing, there is a need for a salad bowl that can be packaged in a full, stabilized state, but also provide the consumer with the ability to toss the salad within the bowl without creating a mess.

Embodiments of the present invention provide an expandable bowl assembly comprising a bowl, the bowl having a top opening, a base, and a side member extending from the top opening to the base, the side member and base defining an interior of the bowl; one or more configuration transition side members each formed as a transition ring-shaped portion of the side member between the top opening and the base of the bowl, each of the one or more configuration transition side members having an inner surface defining a portion of the interior of the bowl; two or more non-transforming side members each formed as a non-transforming ring-shaped portion of the side member disposed such that respective adjacent ones of the two or more non-transforming side members sandwich a respective one of the one or more configuration transition side members, each of the two or more non-transforming side members having an inner surface defining another portion of the interior of the bowl; and a plurality of notched regions formed in each of the one or more configuration transition side members, each of the plurality of notched regions is disposed as a notch having a V-shape when viewed from a side of the bowl, wherein a width of each of the notches being greater proximate the top opening of the bowl, wherein an entirety of the inner surface of each of the two or more non-transforming side members are smooth and continuous about the ring shape, wherein the bowl is transformable between an expanded configuration, where at least one of the one or more configuration transition side members are angled inward and downward toward the base of the bowl, and a collapsed configuration, where an interior volume of the bowl in the expanded configuration is greater than the interior volume of the bowl in the collapsed configuration, and where at least one of the one or more configuration transition side members is sandwiched between the two or more non-transforming side members; and wherein the one or more configuration transition side members and the two or more non-transforming side members are disposed as alternating transition ring shaped portions and non-transforming ring shape portions having a decreasing diameter from the top opening toward the base. In some embodiments each of the plurality of notched regions is disposed as a notch that result in protrusions along the inner surface of the one or more configuration transition side members.

SUMMARY OF THE INVENTION

Embodiments of the present invention provide an expandable bowl assembly comprising a bowl; a lid operable to cover a top opening of the bowl; one or more configuration transition side members extending from the top opening toward a base of the bowl, each of the one or more configuration transition side members formed as a ring-shaped member having an inner surface defining a portion of an interior of the bowl; and one or more non-transforming side members disposed between the top opening and the one or more configuration transition side members, each of the one or more non-transforming side members formed as a ring-shaped member having an inner surface defining another portion of the interior of the bowl, wherein the base is movable between an expanded configuration, where at least one of the one or more configuration transition side members are angled inward and downward toward the base of the bowl, and a collapsed configuration, where each of the one or more configuration transition side members are angled inward and upward toward the top opening of the bowl, where an interior volume of the bowl in the expanded configuration is greater than the interior volume of the bowl in the collapsed configuration.

Embodiments of the present invention further provide a prepackaged salad comprising an undressed salad disposed inside an expandable bowl assembly configured in a collapsed configuration, the expandable bowl assembly including a bowl; a lid operable to cover a top opening of the bowl;

one or more configuration transition side members extending from the top opening toward a base of the bowl, each of the one or more configuration transition side members formed as a ring-shaped member having an inner surface defining a portion of an interior of the bowl; and one or more non-transforming side members disposed between the top opening and the one or more configuration transition side members, each of the one or more non-transforming side members formed as a ring-shaped member having an inner surface defining another portion of the interior of the bowl, wherein the base is movable between an expanded configuration, where at least one of the one or more configuration transition side members are angled inward and downward toward the base of the bowl, and the collapsed configuration, where each of the one or more configuration transition side members are angled inward and upward toward the top opening of the bowl, where an interior volume of the bowl in the expanded configuration is greater than the interior volume of the bowl in the collapsed configuration.

Embodiments of the present invention also provide a method for selling and consuming a prepackaged salad comprising filling an expandable bowl of an expandable bowl assembly, in its collapsed configuration, with salad; placing a lid on the expandable bowl; displaying the prepackaged salad for a consumer; expanding the expandable bowl into an expanded configuration; placing salad dressing on the salad; and mixing the salad dressing with the salad inside the expandable bowl in the expanded configuration, wherein the expandable bowl includes one or more configuration transition side members extending from the top opening toward a base of the expandable bowl, each of the one or more configuration transition side members formed as a ring-shaped member having an inner surface defining a portion of an interior of the expandable bowl, and one or more non-transforming side members disposed between the top opening and the one or more configuration transition side members, each of the one or more non-transforming side members formed as a ring-shaped member having an inner surface defining another portion of the interior of the expandable bowl, wherein the base is movable between the expanded configuration, where at least one of the one or more configuration transition side members are angled inward and downward toward the base of the bowl, and the collapsed configuration, where each of the one or more configuration transition side members are angled inward and upward toward the top opening of the expandable bowl, where an interior volume of the expandable bowl in the expanded configuration is greater than the interior volume of the expandable bowl in the collapsed configuration.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
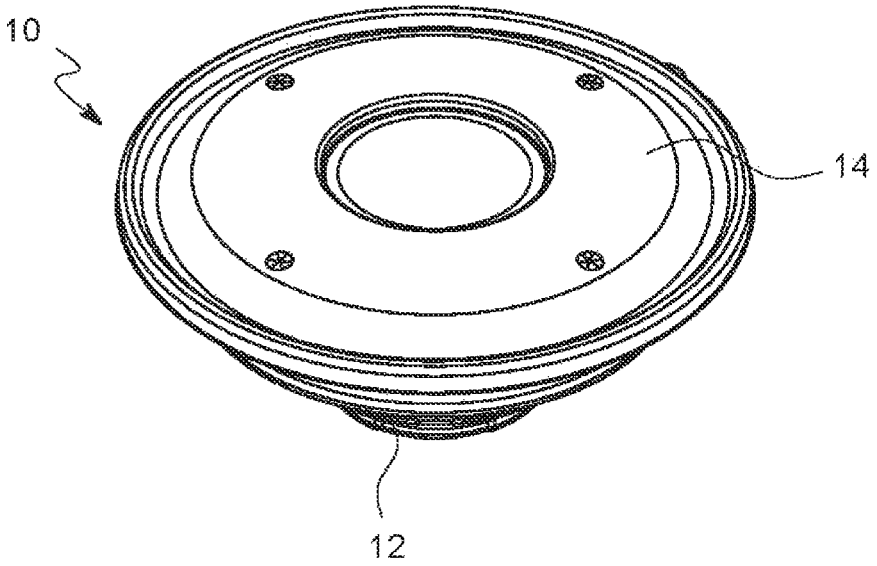
FIG. 1 is a perspective view of an expandable bowl, with its lid disposed thereupon, according to an exemplary embodiment of the present invention.
Figure 2:
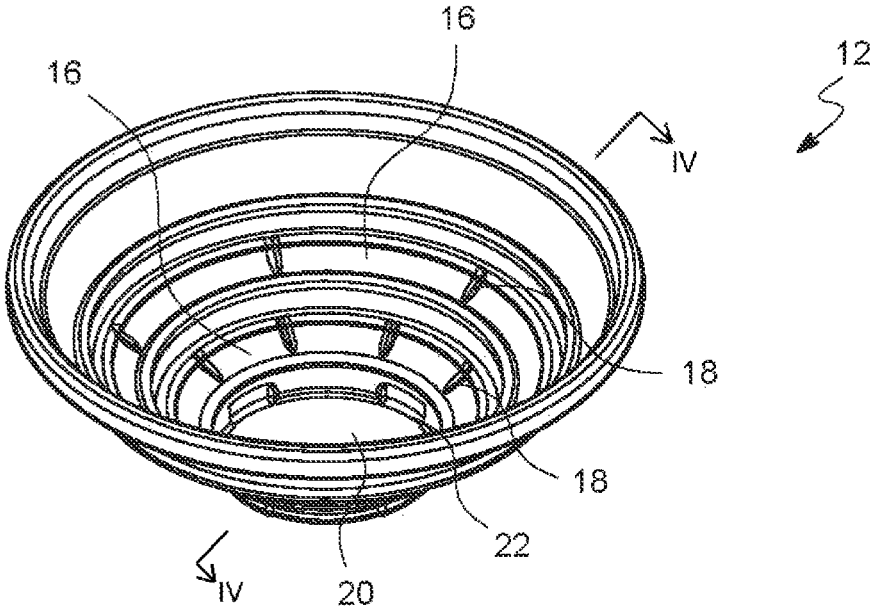
FIG. 2 is a perspective view of the expandable bowl of FIG. 1 will the lid removed.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present disclosure is to be considered as an exemplification of the invention, and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide an expandable bowl having an open top and a plurality of configuration changing side members connecting the open top to a base member. The configuration changing side members are designed to allow a user to squeeze, pull, or generally adjust the base member to change the side members from a collapsed configuration to an expanded configuration, thereby increasing the overall volume of the bowl. The expandable bowl may be useful for various products, such as pre-packaged salads, where the salads may be packaged and displayed in the collapsed configuration, thereby minimizing shelf space and being easily portable by a consumer, fitting into backpacks, purses, briefcases, or the like. Moreover, because the ingredients can be packed to the top in the collapsed configuration, the salad ingredients do not move in the bowl, under the lid, so the salad still looks presentable when eaten. The expandable bowl may be changed to the expanded configuration by a user to permit tossing of the salad without risking spillage of the contents of the bowl. Even if the consumer chooses not to toss the salad, the salad is easier to eat than other salad bowls as 1) the ingredients settle, and 2) the consumer can use their non-eating hand to hold the bowl from underneath, using the same round bottom previously used to expand the bowl as a grip/handle. This makes salad eating more mobile, which is also an important advantage with the expandable bowl of the present invention.

Referring to FIGS. 1 through 6, an expandable bowl assembly 10, or simply bowl assembly 10, can include an expandable bowl 12, or simply bowl 12, and a lid 14 fitting over an open end of the bowl 12.

Figure 3A:
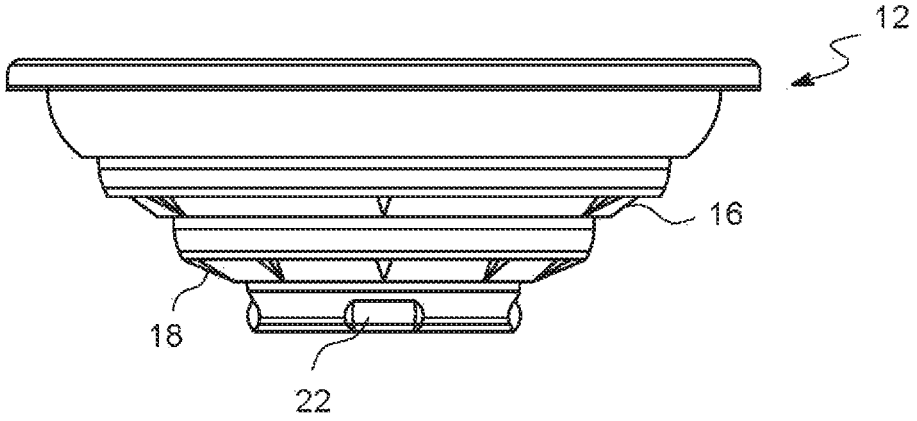
FIG. 3A is a side view of the expandable bowl of FIG. 1 in an expanded configuration.
Figure 3B:
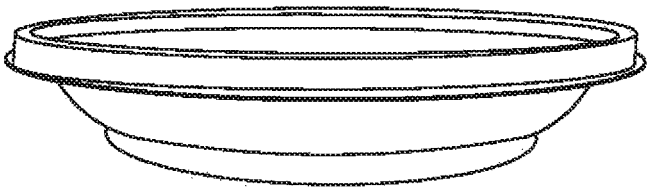
FIG. 3B is a side view of the expandable bowl of FIG. 1 in a collapsed configuration.
Figure 4:
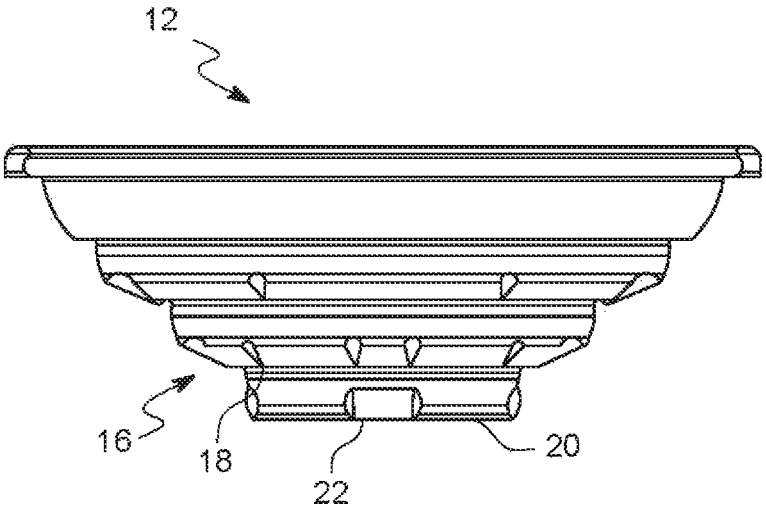
FIG. 4 is a cross-sectional view, taken along line IV-IV of FIG. 2, of the expandable bowl of FIG. 1.

The bowl 12 can be formed from a plurality of configuration transition side members 16 that can permit the bowl 12 to change between an expanded configuration, as shown in FIG. 3A and a collapsed configuration, as shown in FIG. 3B. In some embodiments, the side members 16 can include a plurality of notched regions 18. The notched regions 18 may be disposed equidistantly about the side members 16. The notched regions 18 may include an indent shaped generally in an inverted V-shape, where a width of each of the notched regions 18 is greater proximate to the open end of the bowl 12. The configuration transition side members 16 are generally ring-shaped portions with an inside surface forming a portion of an interior of the bowl 12. As used herein, the term "ring-shaped portion" describes a member that forms a loop. The shape of the ring-shaped portions may be round rings, triangular rings, square rings, oval rings, rectangular rings, or the like. As used herein, the term "ring-shaped member" may be used in place of "ring-shaped portion".

Figure 5:
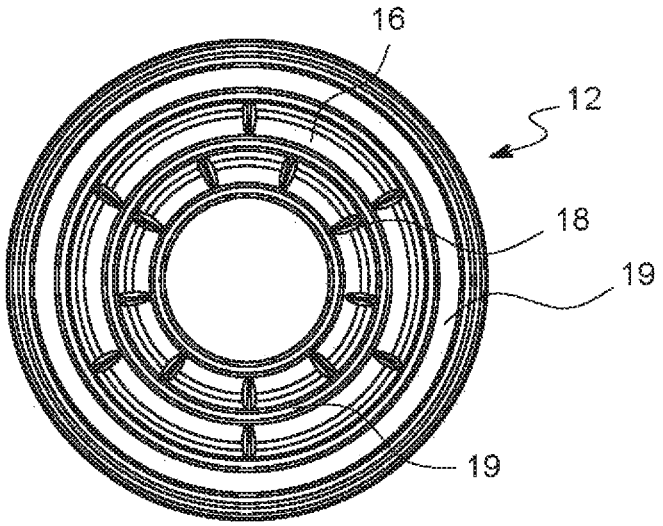
FIG. 5 is a top view of the expandable bowl of FIG. 1.
Figure 6:
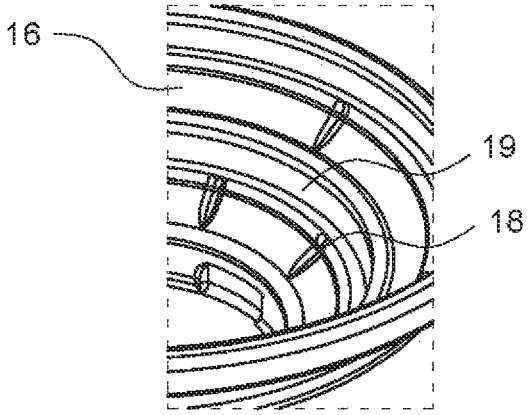
FIG. 6 is a detailed view of an interior portion of the expandable bowl of FIG. 1.

Non-transforming side members 19 may be disposed between the configuration transition side members 16. In some embodiments, as shown in FIG. 5, the non-transforming side member 19 may be disposed between a lid opening and a first configuration transition side member 16. A second non-transforming side member 19 may be disposed between the first configuration transition side member 16 and a second configuration transition side member 16.

The configuration transition side members 16 and the non-transforming side members 19 may be disposed as alternating ring-like members having decreasing diameters from the lid region toward the bottom 20 of the bowl 12. In other words, at least one of the configuration transition side members is sandwiched between the two or more non-transforming side members. In some embodiments, as shown in the Figures, the inner surface of each of the one or more non-transforming side members are smooth and continuous about the ring shape thereof. While two configuration transition side members 16 are shown, additional configuration transition side members 16 may be added to create a deeper bowl and a greater difference in bowl volumes between the expanded and collapsed configurations.

The configuration transition side members 16 may be angled downward, from a surface parallel with the base 20, from about 10 to about 50 degrees, when the bowl 12 is in the expanded configuration, thus creating a bowl-shaped bowl. The configuration transition side members 16 may be angled upward from a line parallel to the bottom 20, or simply angled upward, from 1 to 30 degrees, for example, in the collapsed configuration. The non-transforming side members 19 may remain angled downward regardless of configuration. Typically, the non-transforming side members 19 are angled downward, from a surface parallel with the base 20, at angle from about 40 to about 90 degrees. Typically, the downward angle of the non-transforming side members 19 is greater than the downward angle of the configuration transition side members 16 in the expanded configuration. Thus, in the collapsed configuration, the bottom 20 of the bowl can nest within the bowl 12. Typically, by transforming the bowl 12 from the collapsed configuration to the expanded configuration will result in a volume increase from about 120% to over 200%, typically from about 130% to about 180%.

In some embodiments, the base 20 may include a plurality of pull regions 22, also referred to as finger pull regions 22. The pull regions 22 may be, for example, a flattened region on the circular outer circumference of the bottom 20 to provide ease in transitioning the bowl from the collapsed configuration to the expanded configuration.

Figure 7:
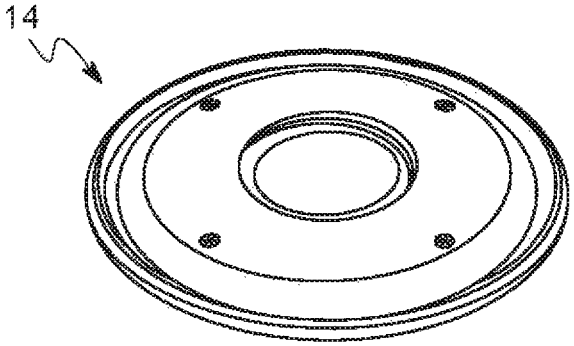
FIG. 7 is a perspective view of the lid of FIG. 1.
Figure 7A:
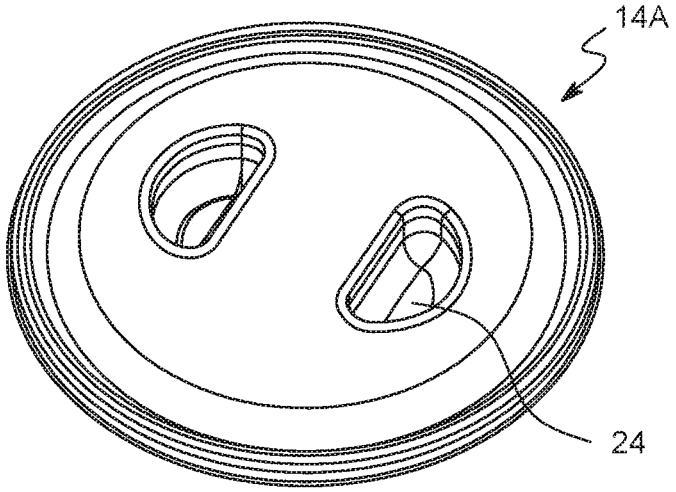
FIGS. 7A and 7B show an alternate embodiment of the lid for use on the bowl of FIG. 1, where the lid can retain a container thereunder, such as a salad dressing.
Figure 7B:
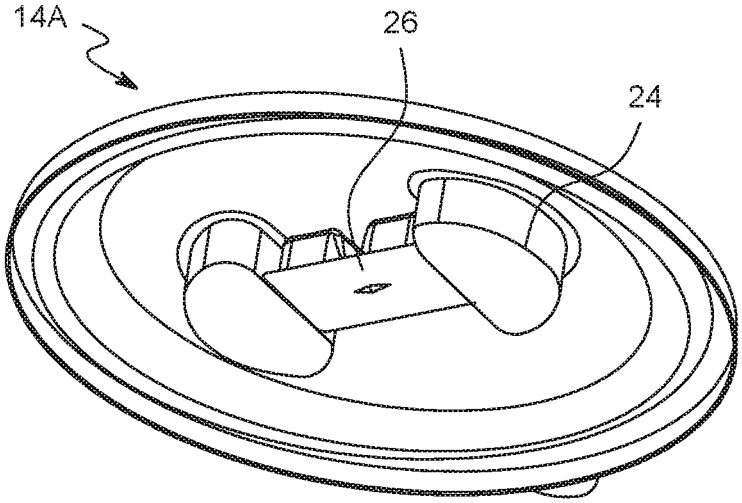
Figure 8:
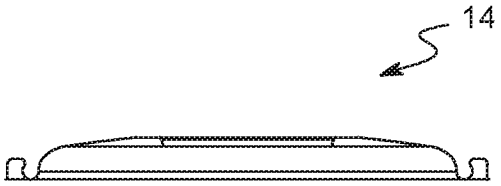
FIG. 8 is a side view of the lid of FIG. 7.

Referring to FIGS. 7 through 8, a lid 14 can be configured to fit over the open end of the bowl. In some embodiments, as shown in FIGS. 7A and 7B, a lid 14A can be designed with indented handles 24 that permit a package 26 to be retained therebetween. The package 26 may be, for example, a salad dressing that can be packaged inside the closed bowl assembly 10.

Figure 9:
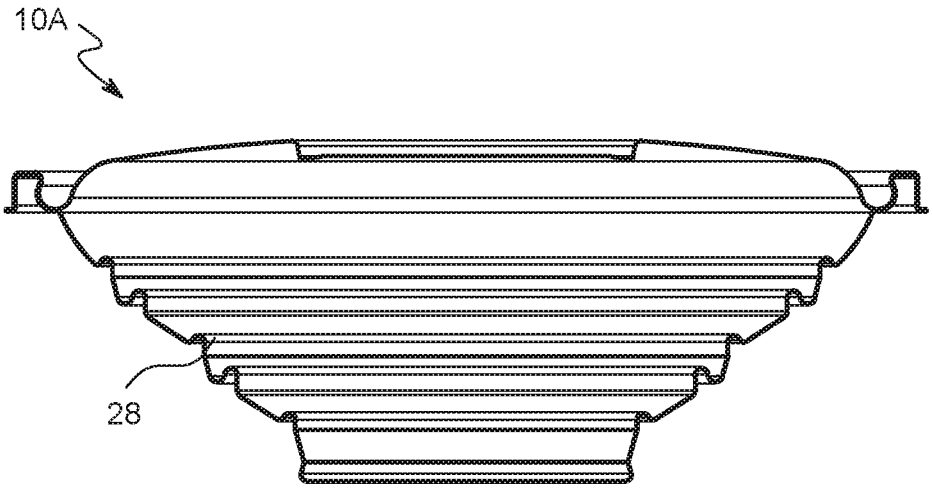
FIG. 9 is a cross-sectional view of an alternate embodiment of an expandable bowl taken along a similar view as that of FIGS. 3A and 4.
Figure 10:
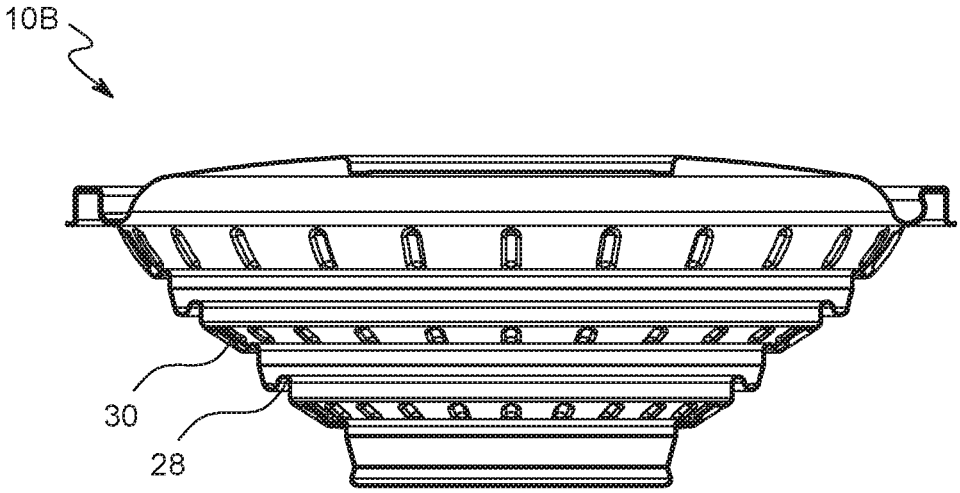
FIG. 10 is a cross-sectional view of another alternate embodiment of the expandable bowl taken along a similar view as that of FIGS. 3A and 4.

Referring to FIG. 9, in some embodiments, a bowl assembly 10A can include a bowl with structural reliefs 28 disposed between each of the configuration transition side members to permit the bowl to change configurations. FIG. 10 shows an embodiment of a bowl assembly 10B with both the structural reliefs 28 as well as notched regions 30 disposed as generally linear notches in the configuration transition side members.

Figure 13:
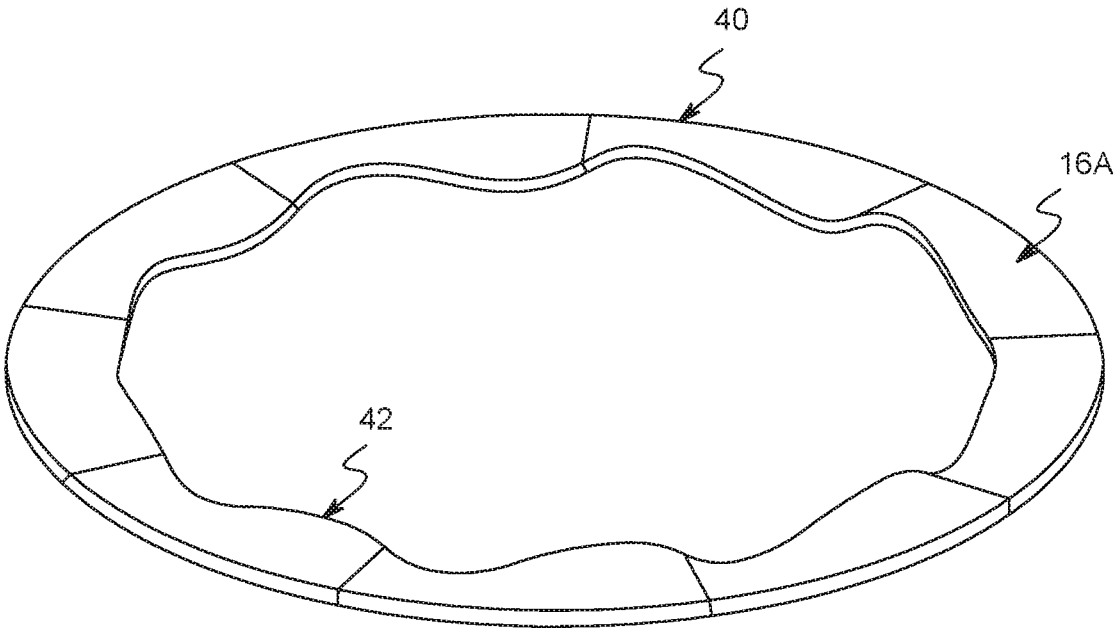
FIG. 13 illustrates an intermediate state of the configuration transition portion of FIG. 11.

While FIGS. 1-6, FIG. 8 and FIG. 9 show various configuration transition side members, regardless of the embodiment, as shown in FIG. 13, an outer circumference 40 of the configuration transition side member 16A is maintained in a constant position, while the inside circumference 42 moves as the configuration transition side member 16A changes between the expanded and collapsed configurations. When the side member 16A is generally parallel to a base (not shown in FIG. 13, see base 20 in FIG. 2, for example), the inside circumference 42 is reduced, resulting in the flexing as shown in FIG. 13. The structural reliefs 28 help permit this flexing.

Various parameters of the structural reliefs 28 and/or notched regions 18, 30 may influence the transition between the collapsed and expanded configurations. In addition to the number of structural reliefs and/or notches, the depth and width of the structural reliefs and/or notches are also important in determining how easily the bowl transitions and stays in the expanded bowl state once transitioned. If the structural reliefs and/or notches are few, small in width or depth, the bowl will not transition easily and will stay in the bowl shape once transitioned therein. The more in number, wider and/or deeper structural reliefs and/or notches, will make facilitation easier but has the potential for the bowl not to be stable in the expanded state, as it may be prone to go back to the collapsed state.

Figure 14:
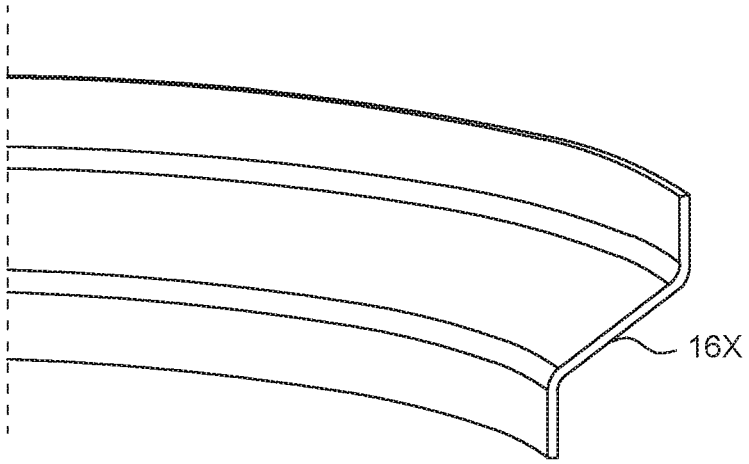
FIG. 14 illustrates a configuration transition portion usable in the expandable bowl according to an exemplary embodiment of the present invention.
Figure 15:
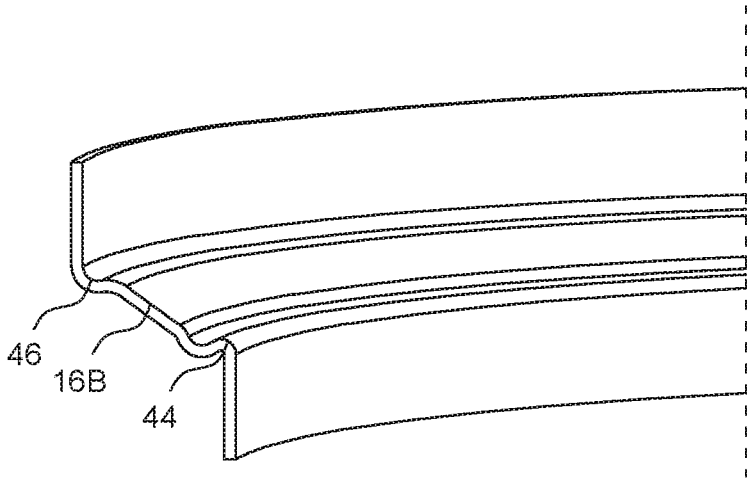
FIG. 15 illustrates another configuration transition portion usable in the expandable bowl according to an exemplary embodiment of the present invention.
Figure 16:
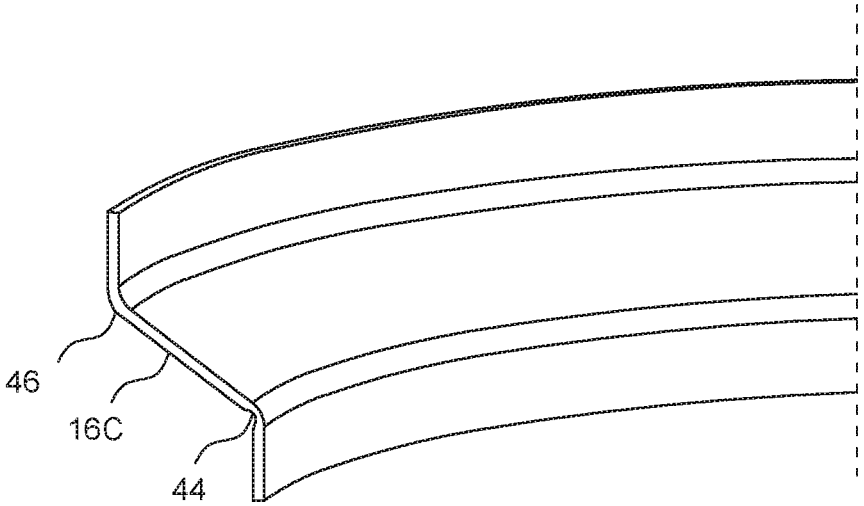
FIG. 16 illustrates another configuration transition portion usable in the expandable bowl according to an exemplary embodiment of the present invention.

Similarly, the notched regions 18, 30 also help permit this flexing. In some embodiments, a configuration transition side member 16X, as shown in FIG. 14, may be formed as side member 16B or 16C, as shown in FIGS. 15 and 16, with hinged region 44 and relief region 46, which may take various forms to permit configuration change.

Figure 11:
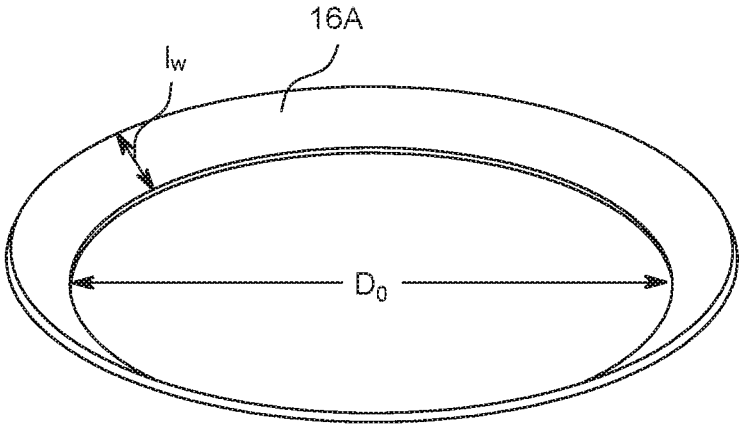
FIG. 11 perspective view of a configuration transition portion of an expandable bowl according to an exemplary embodiment of the present invention.
Figure 12:
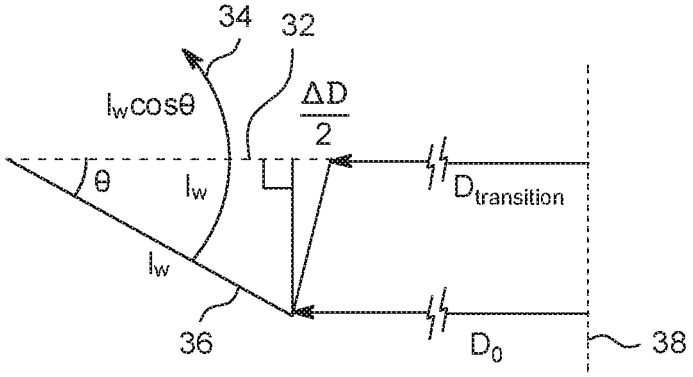
FIG. 12 illustrates variables used for determining forces needed for achieving a configuration transition.

Referring back to FIGS. 11 and 12, various considerations are taken to determine the optimal configuration for permitting flexing of the configuration transition side members to change between the expanded and collapsed configurations. $D_0$ refers to the inside diameter of one of the configuration transition side members 16A in an expanded configuration. $I_w$ refers to the width of the side member 16A. As can be seen from FIG. 12, as the axis of the side member 16A along the width, $I_w$, indicated by line 36, is moved from the expanded configuration (as shown in FIG. 11) to the transition position, indicated by line 32, through angle theta (θ), where arrow 34 indicates the side member's movement, the $D_0$ is decreased to a D (transition). Center line 38 shows an axis orthogonal to the base 20 of the bowl. This reduction in diameter results in the transition mode shown in FIG. 13. As movement continues to the collapsed configuration (see FIG. 3B), the D (transition) is permitted to enlarge back to the $D_0$, thereby locking the bowl in the collapsed configuration. In other words, the transition configuration, as shown in FIG. 13 is a higher energy state that requires energy to move between the collapsed and expanded configurations, and, when the bowl is in either the collapsed or expanded configuration, this "ground state" configuration is locked in so that undesired transition does not occur.

Several factors have been considered with respect to flipping performance, including number and size of the notched regions 18, diameter and thickness of the configuration transition side members, steepness of the angle of the side members in the expanded configuration, and the like. In some embodiments, 5 to 30 notched regions 18, typically 7 to 11 notched regions 18 for single portion salad bowls, may be disposed equidistantly about each of the configuration transition side members 16.

Additionally, the material used for the bowl may influence the flipping performance. However, because of the ability to vary the size, shape and number of the notched regions, for example, one can make use of a wide variety of packaging materials, such as different plastics and the like.

In some embodiments, the bowl assembly 10 may include one or more air vents (not shown). The air vents may be formed, for example, as slits cut into the lid 14 or bowl 12 of the bowl assembly 10. Typically, the air vents may be designed to permit air exchange into and out of the bowl 12 while the lid 14 is still attached to the bowl 12. Thus, with the air vents, a user may be able to change the configuration of the bowl assembly 10 between the expanded and collapsed configurations without creating a reduced or increased pressure inside the bowl 12. In some embodiments, the air vents may be formed along the lid sealing region to the bowl.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. An expandable bowl assembly comprising:

a bowl, the bowl having a top opening, a base, and a side member extending from the top opening to the base, the side member and base defining an interior of the bowl;

one or more configuration transition side members each formed as a transition ring-shaped portion of the side member between the top opening and the base of the bowl, each of the one or more configuration transition side members having an inner surface defining a portion of the interior of the bowl;

two or more non-transforming side members each formed as a non-transforming ring-shaped portion of the side member disposed such that respective adjacent ones of the two or more non-transforming side members sandwich a respective one of the one or more configuration transition side members, each of the two or more non-transforming side members having an inner surface defining another portion of the interior of the bowl; and a plurality of notched regions formed in each of the one or more configuration transition side members, each of the plurality of notched regions is disposed as a notch having a V-shape when viewed from a side of the bowl, wherein a width of each of the notches being greater proximate the top opening of the bowl, wherein an entirety of the inner surface of each of the two or more non-transforming side members are smooth and continuous, wherein the bowl is transformable between an expanded configuration, where at least one of the one or more configuration transition side members are angled inward and downward toward the base of the bowl, and a collapsed configuration, where an interior volume of the bowl in the expanded configuration is greater than the interior volume of the bowl in the collapsed configuration, and where at least one of the one or more configuration transition side members is sandwiched between the two or more non-transforming side members; and wherein the one or more configuration transition side members and the two or more non-transforming side members are disposed as alternating transition ring shaped portions and non-transforming ring shape portions having a decreasing diameter from the top opening toward the base.

2. The expandable bowl assembly of claim 1, wherein the plurality of notched regions includes from about 6 to about 11 notched regions equidistantly spaced about an exterior outer circumference of each of the one or more configuration transition side members.

3. The expandable bowl assembly of claim 1, wherein, in the expanded configuration, the non-transforming side members are angled downward at a first angle and the configuration transition side members are angled downward at a second angle, less than the first angle.

4. The expandable bowl assembly of claim 1, further comprising one or more finger pull regions formed on an exterior circumference of the base.

5. The expandable bowl assembly of claim 1, further comprising a container removably disposed under a lid operable to cover the top opening of the bowl.

6. The expandable bowl assembly of claim 1, wherein at least one of an inner diameter of a selected one of the configuration transition side members, an outer diameter of the selected one of the configuration transition side members, an angle of transition of the configuration transition side members between the collapsed and expanded configurations, and a steepness of angle inward and downward of the configuration transition side members in the expanded configuration are chosen to control a force and load required to make the bowl movable into the expanded configuration from the collapsed configuration and to make the bowl maintain the expanded configuration.

7. A prepackaged salad comprising:

an expandable bowl assembly configured in a collapsed configuration, the expandable bowl assembly operable to receive an undressed salad therein, the expandable bowl assembly including:

a bowl, the bowl having a top opening, a base, and a side member extending from the top opening to the base, the side member and base defining an interior of the bowl;

a lid operable to cover the top opening of the bowl;

one or more configuration transition side members each formed as a transition ring-shaped portion of the side member between the top opening and the base of the bowl, each of the one or more configuration transition side members having an inner surface defining a portion of the interior of the bowl;

two or more non-transforming side members each formed as a non-transforming ring-shaped portion of the side member disposed such that respective adjacent ones of the two or more non-transforming side members sandwich a respective one of the one or more configuration transition side members, each of the two or more non-transforming side members having an inner surface defining another portion of the interior of the bowl; and a plurality of notched regions formed in each of the one or more configuration transition side members, each of the plurality of notched regions is disposed as a notch having a V-shape with a width of each of the notches being greater proximate the top opening of the bowl, wherein an entirety of the inner surface of each of the two or more non-transforming side members are smooth and continuous, wherein the bowl is transformable between an expanded configuration, where at least one of the one or more configuration transition side members are angled inward and downward toward the base of the bowl, and a collapsed configuration, where an interior volume of the bowl in the expanded configuration is greater than the interior volume of the bowl in the collapsed configuration, and where at least one of the one or more configuration transition side members is sandwiched between the two or more non-transforming side members; and wherein the one or more configuration transition side members and the two or more non-transforming side members are disposed as alternating transition ring shaped portions and non-transforming ring shape portions having a decreasing diameter from the top opening toward the base.

8. The prepackaged salad of claim 7, wherein the plurality of notched regions includes from about 7 to about 11 notched regions equidistantly spaced about an exterior outer circumference of each of the one or more configuration transition side members.

9. The prepackaged salad of claim 7, wherein, in the expanded configuration, the non-transforming side members are angled downward at a first angle and the configuration transition side members are angled downward at a second angle, less than the first angle.

10. The prepackaged salad of claim 7, wherein the bowl assembly further comprising one or more finger pull regions formed on an exterior circumference of the base.

11. The prepackaged salad of claim 7, further comprising a salad dressing container removably disposed under the lid.

12. An expandable bowl assembly comprising:

a bowl, the bowl having a top opening, a base, and a side member extending from the top opening to the base, the side member and base defining an interior of the bowl;

one or more configuration transition side members each formed as a transition ring-shaped portion of the side member between the top opening and the base of the bowl, each of the one or more configuration transition side members having an inner surface defining a portion of the interior of the bowl;

two or more non-transforming side members each formed as a non-transforming ring-shaped portion of the side member disposed such that respective adjacent ones of the two or more non-transforming side members sandwich a respective one of the one or more configuration transition side members, each of the two or more non-transforming side members having an inner surface defining another portion of the interior of the bowl; and a plurality of notched regions formed in each of the one or more configuration transition side members, each of the plurality of notched regions is disposed as a notch that result in protrusions along the inner surface of the one or more configuration transition side members, wherein an entirety of the inner surface of each of the two or more non-transforming side members are smooth and continuous, wherein the bowl is transformable between an expanded configuration, where at least one of the one or more configuration transition side members are angled inward and downward toward the base of the bowl, and a collapsed configuration, where an interior volume of the bowl in the expanded configuration is greater than the interior volume of the bowl in the collapsed configuration, and where at least one of the one or more configuration transition side members is sandwiched between the two or more non-transforming side members;

wherein the one or more configuration transition side members and the two or more non-transforming side members are disposed as alternating transition ring shaped portions and non-transforming ring shape portions having a decreasing diameter from the top opening toward the base; and wherein the plurality of notched regions includes from about 6 to about 11 notched regions equidistantly spaced about an exterior outer circumference of each of the one or more configuration transition side members.

13. The expandable bowl assembly of claim 12, wherein, in the expanded configuration, the non-transforming side members are angled downward at a first angle and the configuration transition side members are angled downward at a second angle, less than the first angle.

14. The expandable bowl assembly of claim 12, further comprising one or more finger pull regions formed on an exterior circumference of the base.

15. The expandable bowl assembly of claim 12, further comprising a container removably disposed under a lid operable to cover the top opening of the bowl.

16. The expandable bowl assembly of claim 12, wherein at least one of an inner diameter of a selected one of the configuration transition side members, an outer diameter of the selected one of the configuration transition side members, an angle of transition of the configuration transition side members between the collapsed and expanded configurations, and a steepness of angle inward and downward of the configuration transition side members in the expanded configuration are chosen to control a force and load required to make the bowl movable into the expanded configuration from the collapsed configuration and to make the bowl maintain the expanded configuration.

* * * * *